United States Patent [19]

Black, III et al.

[11] Patent Number: 4,517,422

[45] Date of Patent: May 14, 1985

[54] ELECTRICAL SWITCH HAVING INTERLOCKED BLOWER AND AIR CONDITIONER SWITCH COMPONENTS FOR VEHICLES

[75] Inventors: Charles E. Black, III, Mt. Prospect; Raymond T. Halstead, Wheeling, both of Ill.

[73] Assignee: Indak Manufacturing Corp., Northbrook, Ill.

[21] Appl. No.: 598,840

[22] Filed: Apr. 10, 1984

[51] Int. Cl.[3] ..... H01H 9/26

[52] U.S. Cl. ..... 200/50 C; 200/5 E

[58] Field of Search ..... 200/5 R, 5 B, 5 E, 5 EA, 200/5 EB, 16 C, 16 D, 50 C, 61.86, 15.35

[56] References Cited

U.S. PATENT DOCUMENTS 3,271,536 9/1966 Schink ..... 200/16

4,383,147 5/1983 Raab et al. ..... 200/50 C

*Primary Examiner*—J. R. Scott

*Attorney, Agent, or Firm*—Burmeister, York, Palmatier, Hamby & Jones

[57] ABSTRACT

A combination blower and air conditioner switch is disclosed, comprising a blower switch and an air conditioner switch having respective first and second casings secured together, a blower control member movable along a path between an OFF position remote from the air conditioner switch and at least one ON position closer thereto, an air conditioner control member movable in the second casing between circuit opening and closing positions, a return spring for biasing the air conditioner control member toward its circuit opening position, a latching mechanism including a latching element for latching the air conditioner control member in its circuit closing position, and an interlock mechanism movable between enabling and disabling positions and including a disabling member for engaging and disabling the latching element with the interlock mechanism in its disabling position, the interlock mechanism including a link connected to the disabling member and operable by the blower control member for moving the disabling member to its disabling position when the blower control member is moved to its OFF position, the interlock mechanism including a spring for returning the link and the disabling member to their enabling positions when the blower control member is moved away from its OFF position.

6 Claims, 29 Drawing Figures

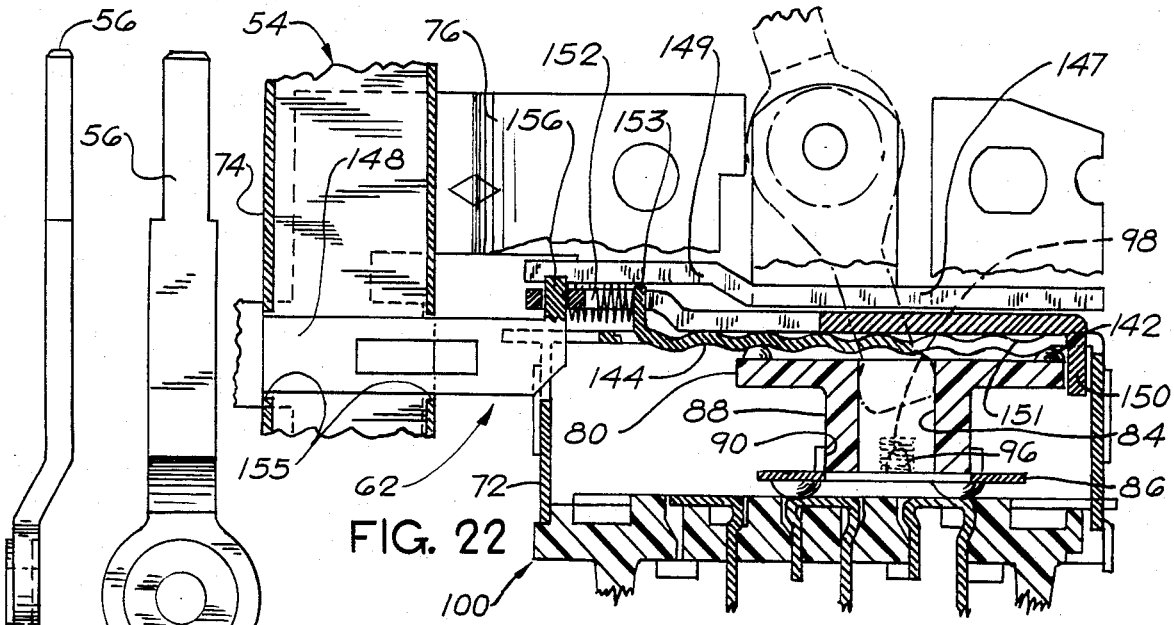
FIG. 22
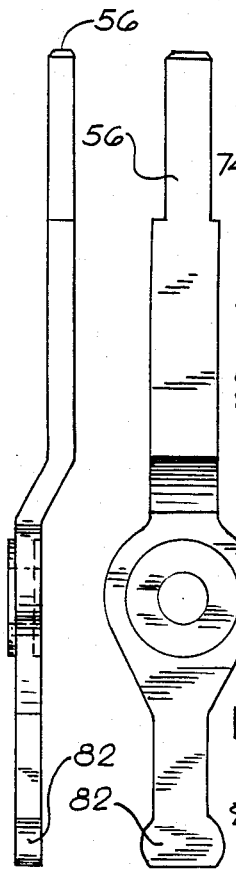
FIG. 24
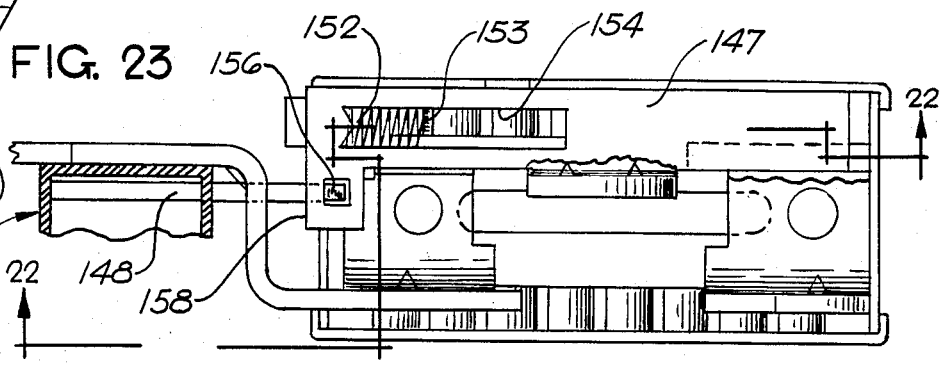
FIG. 23
FIG. 21
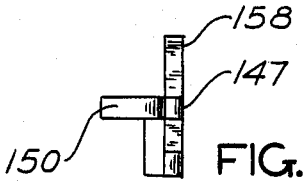
FIG. 27
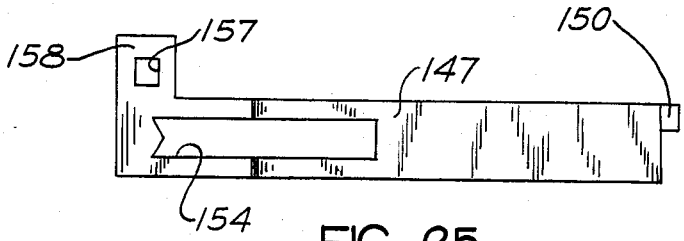
FIG. 25
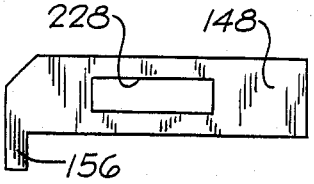
FIG. 28
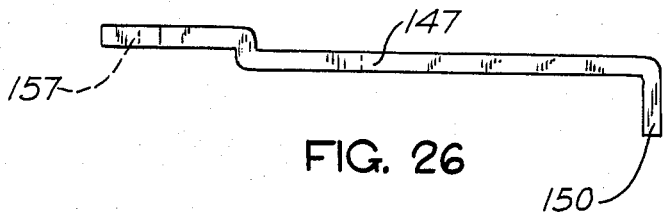
FIG. 26
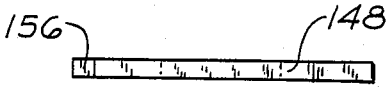
FIG. 29

ELECTRICAL SWITCH HAVING INTERLOCKED BLOWER AND AIR CONDITIONER SWITCH COMPONENTS FOR VEHICLES

FIELD OF THE INVENTION

This invention relates to electrical switches for controlling the blower and the air conditioner for the heating and air conditioning system of an automobile, truck or other vehiclc. Such switches may control the energization and speed of the blower which circulates air to the cab of the vehicle, for both heating and air conditioning, while also controlling the energization of the air conditioning compressor, often by controlling an electrically operable clutch, adapted to transmit power between the engine of the vehicle and the compressor.

BACKGROUND OF THE INVENTION

This invention may be regarded as an improvement in relation to the switch disclosed and claimed in U.S. Pat. No. 4,383,147, issued May 10, 1983 upon the application of Andrew F. Raab and Arthur G. Perkins. Such patent discloses a combination blower and air conditioner switch for vehicles, comprising a blower speed control switch component including a blower control member movable from an OFF position to a series of ON positions to provide different blower speeds, an air conditioner switch component including a push button control member movable between OFF and ON positions against the biasing action of a return spring, latching means including a latching element for latching the push button control member in its ON position, and an interlock member movable by the blower control member to a disabling position for disabling the latching means when the blower control member is in its OFF position, such interlock member being movable to an enabling position for enabling such latching means when the blower control member is moved away from its OFF position to any of it ON positions, whereby the push button air conditioner control member cannot be latched in its ON position when the blower control member is in its OFF position. The latching means may be of the alternate latching type for alternately latching and unlatching the push button air conditioner control member in response to successive pushes thereof. The latch disabling action of the interlock member prevents the build-up of frost on the cooling coil of the air conditioner by preventing operation of the air conditioner unless the blower is energized to circulate air through the cooling coil.

In the illustrative embodiment of the switch, as disclosed in such patent, the air conditioner switch component is securely mounted alongside the blower switch component. The blower control member is movable from an OFF position, close to the air conditioner switch component, to a series of ON positions, more remote from the air conditioner switch component. The blower control member is operated by a manually operable lever, so that the OFF position of the lever is remote from the air conditioner switch component, while the ON positions of the lever are closer to the air conditioner switch component.

It is often desirable to reverse the sequence of the OFF and ON positions of the blower control member, for increased convenience and compatibility with the design requirements of various vehicles.

The present invention deals with the problem of producing a combination blower control and air conditioner switch, of the general construction disclosed and claimed in such patent, in which the sequence of the blower OFF and ON positions is reversed, so that the OFF position of the blower control member is remote from the air conditioner switch, while the ON positions of the blower control member are closer to the air conditioner switch. With this reversal, the OFF position of the operating lever is close to the air conditioner switch, while the ON positions of the lever arc more remote from the air conditioner switch.

SUMMARY OF THE INVENTION

To deal with this problem, the present invention may provide a combination blower and air conditioner switch device for vehicles, comprising a blower sWitch having first casing means, an air conditioner switch having second casing means secured alongside the first casing means, a blower control member movable in the first casing means along a path between an OFF position remote from the second casing means and at least one ON position along such path closer to the second casing means, blower contact means operable by the blower control member to an open position when the blower control member is in its OFF position while being operable to a closed position with the blower control member in its ON position, means for moving the blower control member along such path, an air conditioner control member movable in the second casing means between circuit opening and closing positions, a return spring for biasing the air conditioner control member toward its circuit opening position, air conditioner contact means operable by said air conditioner control member to an open position with said air conditioner control member in such circuit opening position while being operable to a closed position with the air conditioner control member in its circuit closing position, latching means for latching the air conditioner control member in its circuit closing position, such latching means including a latching element, and interlock means movable between enabling and disabling positions and including a disabling member for engaging the latching element to disable the latching means with the interlock means in its disabling position, such interlock means including operating means connected to the disabling member for moving the disabling member to its disabling position when the blower control member is moved away from the direction of the second casing means to such OFF position while moving such disabling member to such enabling position when the blower control member is moved from its OFF position toward such second casing means, such latching means thereby being disabled from latching the air conditioner control member in its current closing position when the blower control member is in its OFF position, such latching means being enabled to latch the air conditioner control member in its circuit closing position when the blower control member is moved away from its OFF position to said ON position.

The operating means may include a link connected to said disabling member and movable generally parallel with the blower control member. Such link may have a tab portion projecting into the path of the blower control member as it is moved toward its OFF position.

The operating means may include spring means for biasing the disabling member toward its enabling position, so that the latch element is enabled when the blower control member is moved away from its OFF position and out of engagement with the tab portion of such link. Means may be provided on the first casing means for slidably guiding such link. Such guide means may form a slidable guideway on the outside of the blower switch casing means.

BRIEF DESCRIPTION OF THE DRAWINGS

Further objects, advantages and features of the present invention will appear from the following description, taken with the accompanying drawings, in which:

FIG. 21 is an enlarged fragmentary front elevation, with portions broken away and shown in section, to reveal details of the interlock mechanism.

FIG. 22 is a fragmentary enlarged section, taken generally along the line 22—22 in FIG. 21, to show additional details of the interlock mechanism and the blower switch.

FIGS. 23 and 24 are plan and side views of the blower switch operating lever.

FIGS. 25–27 are enlarged broad side, edge and end views of the operating link for the interlock mechanism.

FIGS. 28 and 29 are enlarged broad side and edge views of the disabling member for the interlock mechanism.

DETAILED DESCRIPTION OF ILLUSTRATIVE EMBODIMENT

Figure 2:
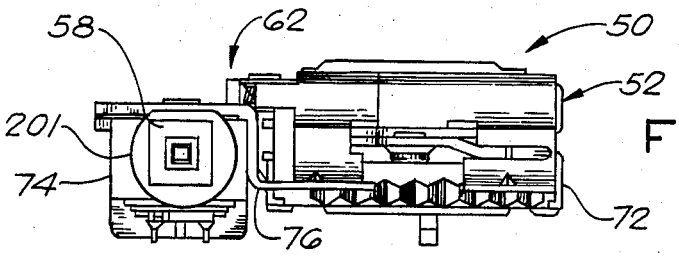
FIGS. 2 and 3 are front and rear elevational views of the switch of FIG. 1.
Figure 1:
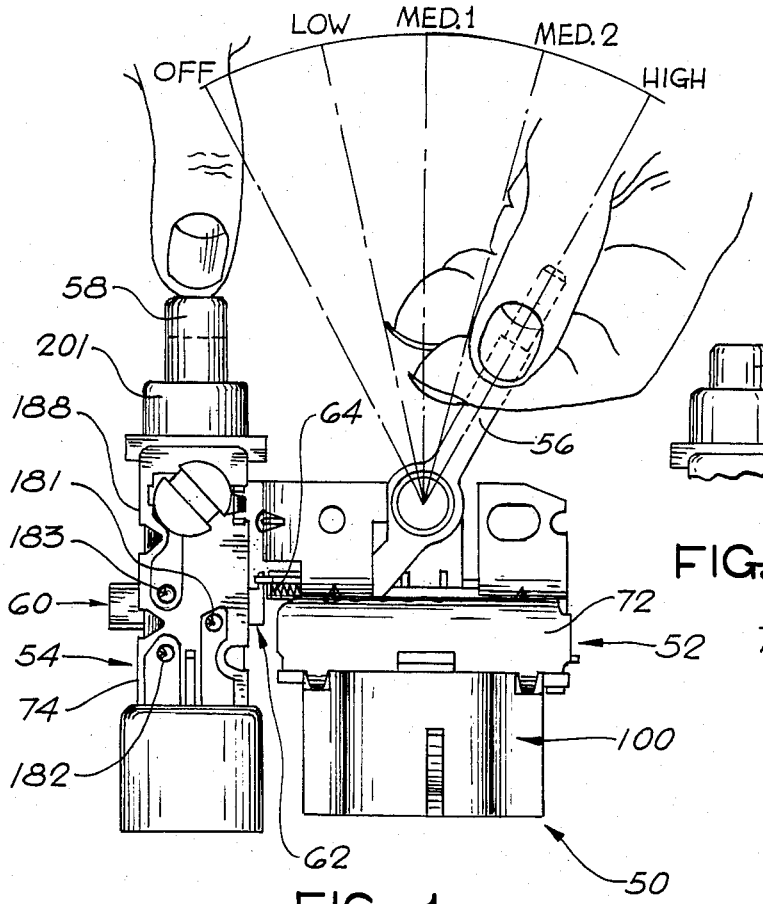
FIG. 1 is a plan view of a combination blower and air conditioner switch, to be described as an illustrative embodiment of the present invention.

As indicated above, the drawings illustrate an illustrative embodiment of the present invention, in the form of a combined electrical switch 50 having a blower switch component 52 which is interlocked with an air conditioner switch component 54, intended particularly for controlling the heating and air conditioning system of an automobile, truck or other vehicle. The blower switch component 52 has a movable operating member in the form of a swingable control lever 56 which is movable to a series of positions for controlling the energization and the speed of the blower motor in the heating and air conditioning system. As shown in FIG. 1, the lever 56 is movable to an OFF position, in which the blower motor is deenergized, a LOW position, in which the blower motor is energized at a low speed, two medium speed positions MED 1 and MED 2, and a high speed position HI.

Figure 5:
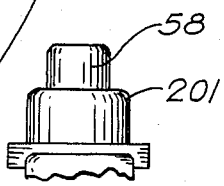
FIG. 5 is a fragmentary view, similar to a portion of Fig. 1, showing the depressed position of the push button for the air conditioner switch component.
Figure 4:
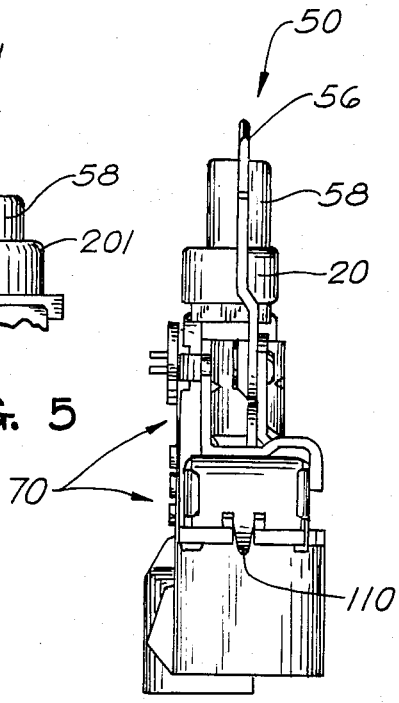
FIG. 4 is a side elevation of the switch.

The air conditioner switch component 54 comprises a movable operating member in the form of a push button 58, which is normally biased outwardly to its OFF position, as shown in FIG. 1, in which the air conditioner is deenergized, but is adapted to be depressed or moved inwardly to its ON position, as shown in FIG. 5, in which the air conditioner is energized. As will be described presently, the air conditioner switch component 54 includes means for latching the operating push button 58 in its depressed or ON position. However, the combined switch 50 includes interlock means 60 for preventing the latching of the push button 58 when the blower switch lever 56 is in its OFF position. Such interlock means 60 may include a movable interlock linkage 62 which extends between the blower switch component 52 and the air conditioner switch component 54. The latch disabling action of the interlock means 60 occurs only when the blower switch lever 56 is in its OFF position. The latching of the push button 58 is enabled when the switch lever 56 is moved away from its OFF position to any of its ON positions, designated LOW, MEDl, MED2 and HI in FIG. 1.

In this way, the push button 58 can be latched in its ON position, to energize the air conditioner, when the blower motor is energized at low speed or at any higher speed, so that sufficient air is circulated by the blower to prevent the building up of frost on the air conditioner cooling coil. When the blower switch lever 56 is in its OFF position, to deenergize the blower motor, the latching of the air conditioner push button 58 is disabled to avoid energizing the air conditioner when the blower is not circulating air through the cooling coil. Such operation of the air conditioner would be likely to cause frost to build up on the cooling coil.

The air conditioner switch component 54 is of the alternate latching type, in which the push button 58 is alternately latched and unlatched, in response to successive movements of the push button to its fully depressed position. The push button 58 is latched in a partially depressed position, in which the air conditioner switch component 54 is ON or closed. A switch of this alternate latching type is often referred to as a Push-Push switch, with reference to the fact that one push of the push button 58 causes it to latch in its ON position, while the next push causes the push button 58 to return outwardly to its OFF position.

The movable interlock linkage 62 is preferably biased toward its enabling position by a return spring 64. When the blower switch lever 56 is moved to its OFF position, the interlock linkage 62 is moved to its disabling position, against the biasing action of the spring 64, so that the latching of the push button 58 is disabled.

Figure 6:
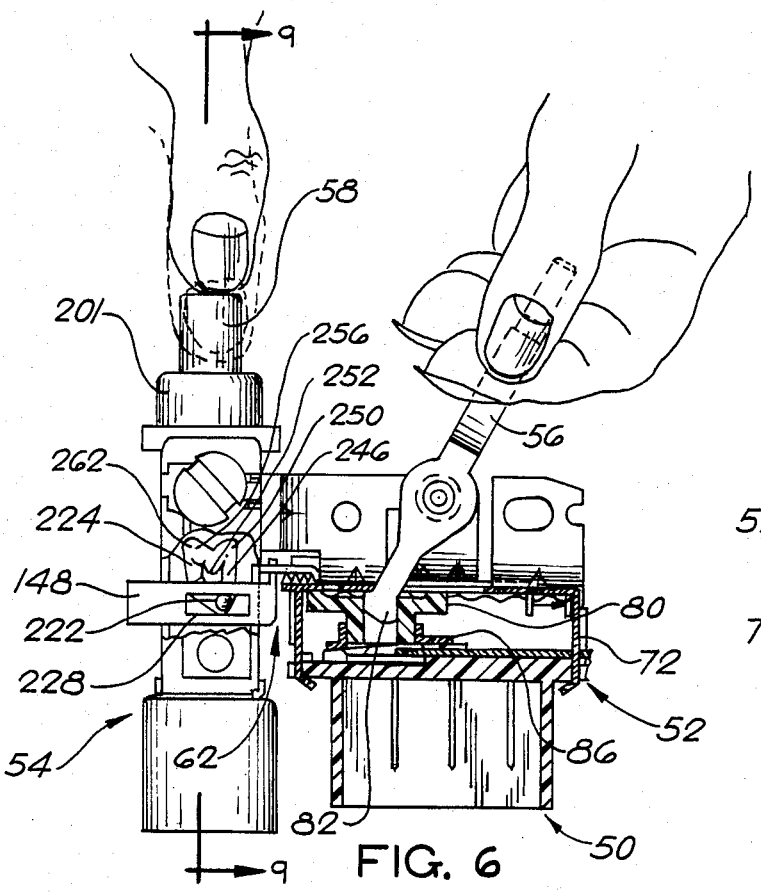
FIG. 6 is a view similar to FIG. 1, but with portions of the switch shown in section and broken away, the blower switch component being shown in its high speed position.
Figure 8:
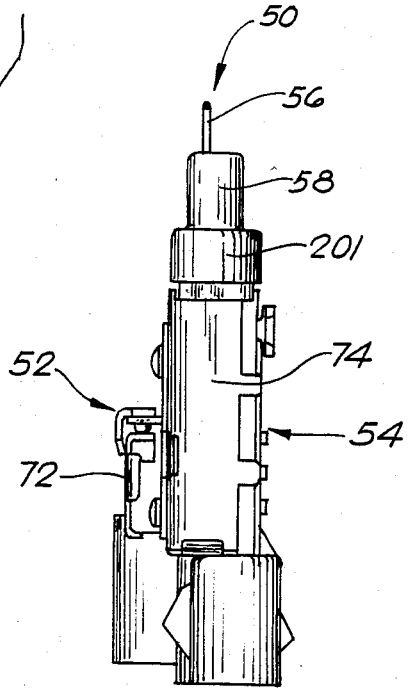
FIG. 8 is a side elevation of the switch, showing the opposite side from that shown in FIG. 4.
Figure 7:
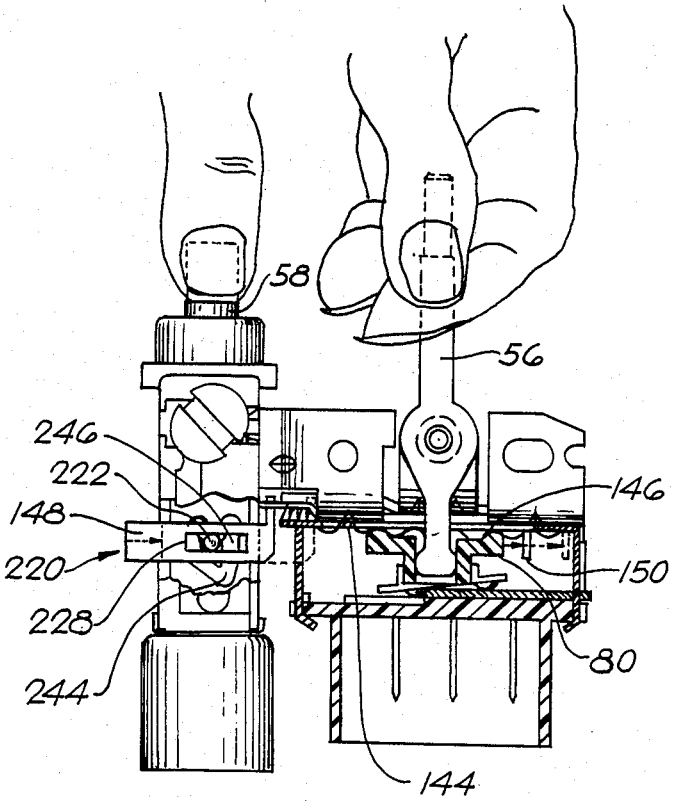
FIG. 7 is a view similar to FIG. 6, but with the blower switch shown in full lines in one of its medium speed positions, the interlock mechanism being shown in broken lines in its OFF or disabling position, for disabling the latching means.

Additional details of the combined switch 50 are shown in FIGS. 6–9. The combined switch 50 comprises casing means 70, including a blower switch casing 72, an air conditioner switch casing 74, and a common mounting bracket 76, on which the casings 72 and 74 are securely mounted The blower switch component 52 comprises a movable control member in the form of a carriage 80 which is movable longitudinally within the casing 72 along a predetermined path. Details of the carriage 80 are shown in FIGS. 6, 7 and 22. The operating lever 56 is adapted to move the carriage 80 along its path. For this purpose, the lever 56 has an arm 82 which is slidably received in a slot 84, formed in the carriage 80. Preferably, the carriage 80 is made of a resinous plastic material or some other material which is an electrical insulator.

The movable carriage 80 is adapted to operate the contact means of the blower switch component 52. As shown, a movable contactor 86 is mounted on the carriage 80, for movement therewith along its path. The contactor 86 is shown to best advantage in FIGS. 6, 10 and 22. Generally, the contactor 86 is in the form of a plate made of copper or some other electrically conductive material. The contactor 86 is mounted on the carriage 80 and is caused to move therewith by a projection 88 extending from one side of the carriage 80 and slidably received in the corresponding slot 90 in the contactor 86. In FIG. 22, the contactor 86 is shown mounted on the carriage 80. The illustrated contactor 86 is formed with three contact points 91, 92 and 93 projecting from the rear side thereof and shown as being spherically rounded in shape. The other side of the contactor 86 is formed with a pair of points or bosses 94 which are adapted to receive and locate coil springs 96, adapted to be compressed between the contactor 86 and the carriage 80. The coil springs 96 are received and located in sockets or recesses 98, formed in the carriage 80.

Figure 10:
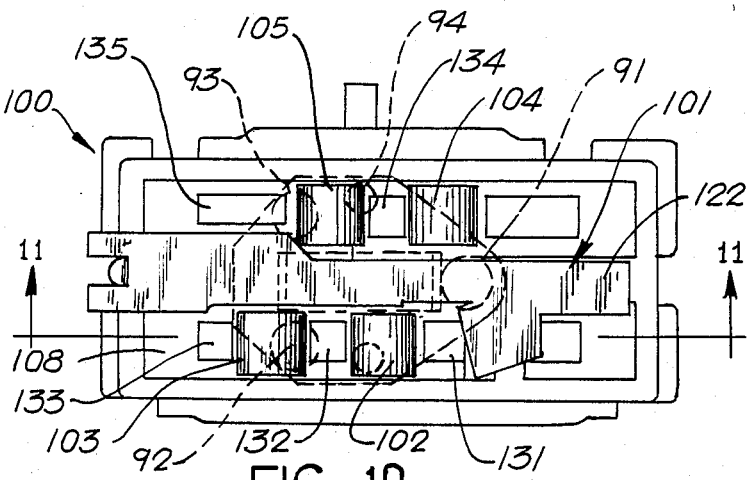
FIG. 10 is a front elevation of the contact board, removed from the blower control switch, with the movable contactor shown in broken lines.
Figure 14:
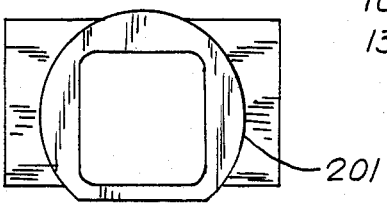
Figure 15:
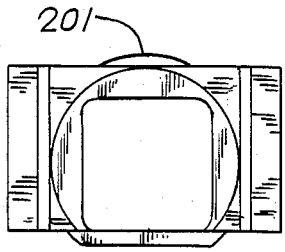
Figure 11:
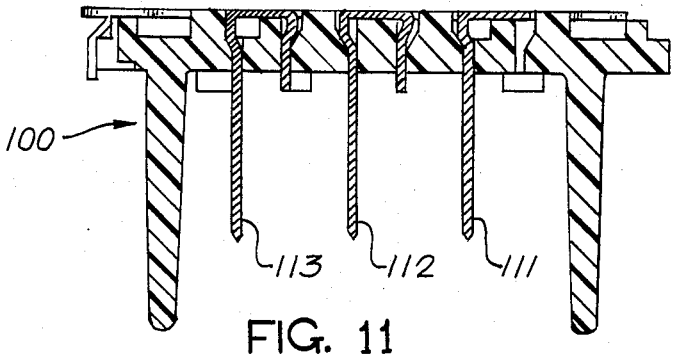
FIG. 11 is a section, taken generally along the line 11—11 in FIG. 10.
Figure 16:
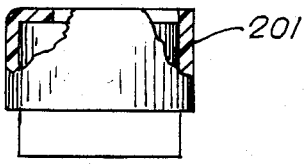
Figure 12:
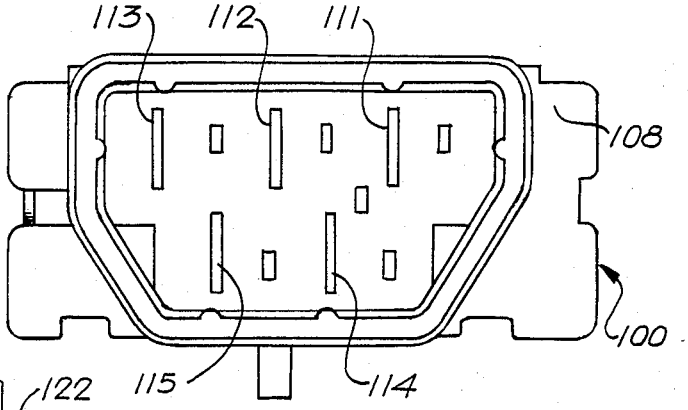
FIG. 12 is a rear view of the blower switch terminal board or head.
Figure 17:
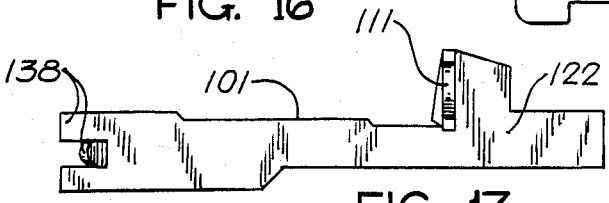
FIGS. 17 and 18 are elevation and plan views of one of the fixed contact members for the blower switch.
Figure 18:
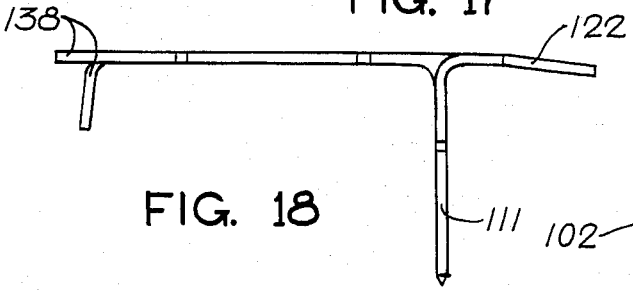
Figure 19:
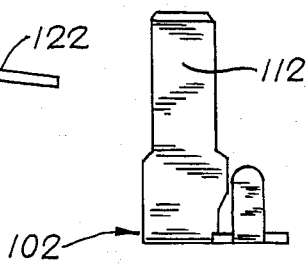
FIGS. 19 and 20 are opposite side views of another fixed contact member for the blower switch.
Figure 20:
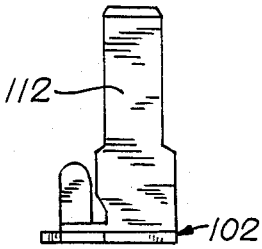

The blower switch component 52 comprises a terminal head 100 which carries a set of fixed contacts 101, 102, 103, 104 and 105, as shown to best advantage in FIG. 10.

The fixed contacts 101–105 are engageable by the contactor 86 as it is moved along its path in the blower switch component 52. The terminal head 100 includes a terminal board or plate 108 for supporting the fixed contacts 101–105. The supporting plate 108 is made of an electrically insulating material, such as a suitable resinuous plastic material. The insulating plate 108 is secured to the rear of the casing 72, as by means of bent over tabs 110, formed on the casing 72. The plate 108 forms the rear wall of the casing 72.

In order that the contacts 101–105 may be connected to external circuit wires, the contacts 101–105 are provided with terminals in the form of lugs or prongs 111, 112, 113, 114 and 115, which in this case are formed in one piece with the respective contacts 101–105. The terminal prongs 111–115 extend rearwardly through corresponding slots in the insulating plate 108 and are adapted to receive a removable electrical connector, for connecting the switch contacts 101–105 to the electrical circuit for the blower motor. In this case, the terminal head 100 is formed with a rearwardly projecting shroud or wall 118 which forms a protective perimeter around the contact prongs 111–115, but is open to the rear to form an opening 120 adapted to receive an electrical connector.

The fixed contacts 101–105 are selectively engageable by the contact points 91, 92 and 93 on the movable contactor 86. The springs 96 provide spring biasing forces between the contactor 86 and the fixed contacts 101–105.

As shown in FIG. 10, the fixed contact 101 includes an elongated, centrally disposed contact bar 122 which is slidably engaged by the contact point 91, throughout the range of movement of the contactor 86. The contacts 102 and 103 are localized and are in a row parallel with the contact bar 122 and along one side thereof. The contacts 104 and 105 are localized and are in another row, parallel with the contact bar 122 and along the opposite side thereof.

As shown in FIG. 10, insulating points or bosses 131, 132 and 133 are formed on the insulating plate 108 so as to alternate with the fixed contacts 102 and 103. Similarly, insulating points or bosses 134 and 135 are formed on the insulating plate 108 so as to alternate with the fixed contacts 104 and 105.

In the OFF position of the blower switch component 52, the contact point 91 on the contactor 86 engages the central contact bar 122 on the contact 101, while the contact points 92 and 93 engage the insulating bosses 133 and 135. Thus, the contactor 86 does not complete any electrical circuit.

In the LOW position of the switch, the contact point 92 engages the fixed contact 103, while the contact point 93 still engages the insulating boss 135. The contact point 91 continues to engage the contact bar 122, in all of the positions of the switch.

In the MED1 position of the switch component 52, the contact point 92 engages the insulating boss 132, while the contact point 93 engages the fixed contact 105.

In the MED2 position of the switch component 52, the contact point 92 engages the contact 102, while the contact point 93 engages the insulating boss 134.

In the HI position of the switch component 52, the contact point 92 engages the insulating boss 131, while the contact point 93 engages the contact 104.

As shown in FIG. 10, the fixed contact 101 has a portion 138 which is adapted to engage a portion of the metal casing 72 for the blower switch component 52, so as to provide an electrical connection between the contact 101 and the casing 72. The portion 138 may engage a tab 140 on the casing 72.

The blower switch component 52 is preferably provided with detent means for lightly detaining the movable carriage 80 in each of its five positions. Such detent means may include interengageable detent elements on the carriage 80 and on the casing 72. As shown in FIGS. 6 and 22, the detent elements on the carriage 80 may be in the form of detent bumps or points 142 projecting from one side of the carriage 80 at the four corners thereof. As shown in FIGS. 6 and 7, the detent elements on the casing 72 may be in the form of detent recesses 144 alternating with a series of detent bumps 146 projecting rearwardly from the front wall of the casing 72. The coil springs 96 are compressed between the contactor 86 and the carriage 80, so that the coil springs 96 are effective to bias the detent bumps 142, formed on the carriage 80, against the detent recesses and bumps 144 and 146 on the casing 72.

The interlock linkage or mechanism 62 is adapted to be operated by the movement of the carriage 80 to its OFF position in the blower switch casing 72, such OFF position being remote from the air conditioner switch 54. As shown to best advantage in FIGS. 21 and 22, the interlock linkage 62 may comprise a slidable link 147, operable by the carriage 80 and connected to a latch disabling member 148, extending into the air conditioner switch 54. The link 147 is slidably guided in a slideway member 149, secured to the outside of the blower switch casing 72. The slideway member 149 may be a portion of the bracket 76. The link 147 has a tab or flange 150 which projects into the path of the carriage 80 as it is moved to its OFF position, as shown in FIG. 22, so that the tab 150 and the link 147 are moved to the right. The tab 150 extends through a slot 151 in the front wall of the casing 72. The carriage 80 thus moves the tab 150 and the link 147 to their latch disabling position.

The link 147 is biased in the opposite direction, toward its latch enabling position, by spring means, shown as a coil spring 152, compressed between the link 147 and a tab 153 on the front wall of the casing 72. The spring 152 is positioned in a slot 154 formed in the link 147.

The link 147 is connected or linked to the latch disabling member 148, which is slidable in a slot 155 formed in the air conditioner switch casing 74. A disengageable connection is formed between the link 147 and the latch disabling member 148 by a prong or tab 156 on the member 148, extending through a slot 157 in a tab 158, formed on the link 147. This disengageable connection makes it easy to assemble the link 147 and the latch disabling member 148. The coil spring 152 also biases the disabling member 148 toward its enabling position. Further details of the latch disabling member 148 will follow herein.

Figure 9:
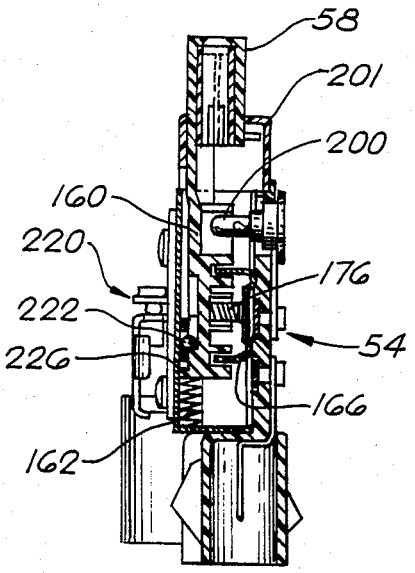
FIG. 9 is a view similar to FIG. 8, but with the air conditioner switch shown in section, generally along the line 9—9 in FIG. 6.
Figure 13:
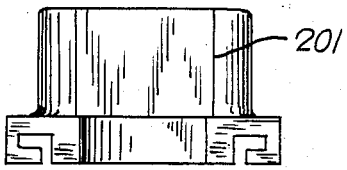
FIGS. 13, 14, 15 and 16 are plan, front, rear and side views of a guide member for the push button of the air conditioner switch.

Additional details of the air conditioner switch component 54 are shown in FIG. 9. The operating member or push button 58 comprises the front portion of a carriage 160 which is slidable longitudinally in the casing 74. The push button 58 is biased outwardly to its OFF position by a return spring 162, compressed between the rear end of the carriage 160 and the rear wall 164 of the casing 74.

The air conditioner switch component 54 comprises contact means for controlling the energization of the air conditioner circuit. Such contact means may include an electrically conductive contactor 166 which is movable with the carriage 160.

The construction of the air conditioner switch component 54 is essentially the same as disclosed in the previously mentioned U.S. Pat. No. 4,383,147, to which reference is made for a highly detailed description, which is hereby incorporated herein. Except as differently described herein, the construction of the air conditioner switch component 54 may be the same as disclosed in such patent. The following description incorporates a summary of the detailed description of the air conditioner switch component 54.

The push button 58 and the carriage 160 are preferably made in one piece of an electrically insulating material, such as a suitable resinous plastic. The contactor 166 is preferably made of copper or some other suitable electrically conductive material. The contactor 166 is movable longitudinally with the carriage. The contactor 166 is biased away from the carriage 160 by a coil spring 176. When the push button 58 is depressed, the contactor 166 is movable into engagement with three fixed contacts in the form of contact rivets 181, 182 and 183, mounted on an insulating board 188 which forms one wall of the casing 74.

Figure 3:
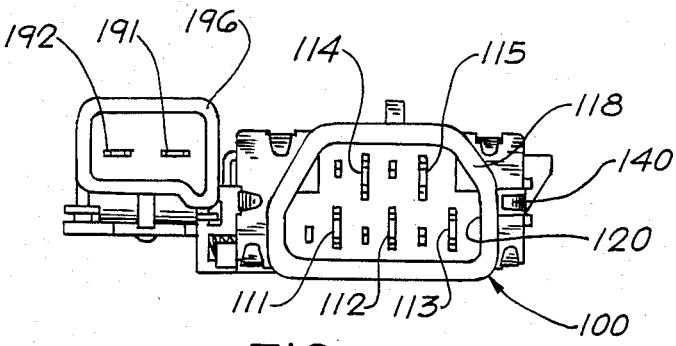

As shown in FIGS. 1 and 3, terminals 191, 192 and 193 are secured to the contact rivets 181, 182 and 183. The terminals 191 and 192 are in the form of flat lugs, projecting rearwardly into a shroud 196 and adapted to receive a removable electrical connector. The third terminal 193 provides a connection to a small signal lamp 200, adapted to illuminate the interior of the push button 58 when the air conditioner switch 54 is in its ON position. The push button 58 is slidable in a tubular guide 201.

When the push button 58 is in its initial extended position, the contactor 166 does not engage any of the fixed contacts 181, 182 and 183, but when the push button 58 is pushed rearwardly against the action of the spring 162, the contactor engages all three contacts 181, 182 and 183, so that all three contacts are connected together. This is the ON position, in which the air conditioner clutch is energized and the lamp 200 is lighted.

As previously indicated, the air conditioner switch component 54 includes a latching mechanism 220 for latching the push button 58 in its ON position, in which it closes the energizing circuit for the air conditioner. The latching mechanism 220 is shown to best advantage in FIGS. 6, 7, and 9. Except for the operation of the latch disabling member 148, the latching mechanism is the same as described and illustrated in the previously mentioned U.S. Pat. No. 4,383,147, to which reference is made for a highly detailed description and illustrations, which are hereby incorporated herein by reference. A brief description of the latching mechanism 220 follows below.

The latching mechanism 220 is of the alternate latching type, whereby the push button 58 is alternately latched and unlatched, in response to successive pushes of the push button 58 to its fully depressed position. When the push button 58 is in its OFF or extended position, and the push button is pushed to its fully depressed position and then is released, the push button 58 is latched by the mechanism 220 in a partially depressed position, in which the switch is closed or ON. When the push button 58 is again pushed to its fully depressed position and released, the push button is unlatched by the mechanism 220, so that the push button is returned to its fully extended or OFF position.

The latching mechanism 220 comprises a ball 222 which is employed as a latching element and is received in a latching track or recess 224, formed in one side of the movable switch carriage 160. In this case, the latching track 224 and the contactor 166 are on opposite sides of the carriage 160. Figs. 6 and 7 are somewhat diagrammatic, in that the latching track 224, is on the opposite side of the carriage 160 from the direction in which FIGS. 6 and 7 are viewed. Thus, the latching track 224 is being viewed from its back side in FIGS. 6 and 7.

The latching ball 222 is confined in the track 224 by one wall 226 of the casing 74. The ball 222 is also confined in a slot 228 formed in the movable latch disabling member 148. The guide slot 228 extends transversely to the direction of movement of the switch carriage 160. The disabling member 148 is positioned between the switch carriage 160 and the casing wall 226. The carriage 160 is biased toward the disabling member 148 by the coil spring 176 which also biases the contactor 166. As previously mentioned, the latch disabling member 148 is slidable in a slot 155 extending through the side walls of the casing 74.

As shown in FIGS. 6 and 7, the latching track 224 forms a complete circuit or loop which is generally heart shaped or triangular. When the push button 58 is moved longitudinally, the transverse guide slot 228 in the disabling member 148 prevents the ball 222 from moving longitudinally, but permits the ball to move laterally along the slot 228.

FIG. 6 shows the initial position of the push button 58, in which it is in its fully extended or OFF position. The ball 222 is in a starting or unlatched recess 244 at the beginning of a first groove portion 246 of the track 224.

When the push button 58 is depressed, the track 224 is moved relative to the ball 222, so that the ball 222 has relative movement along the first groove portion 246 until the ball snaps into a second groove portion 250 of the track 224. When the push button 58 is allowed to return outwardly, the ball 222 has relative movement along the second groove portion 250, which is somewhat diagonal, until the ball 222 is engaged by a latching seat 252, so that the ball latches the push button 58 in the partially depressed position, shown in FIG. 7, which is the ON position of the air conditioner switch 54.

The latching seat 252 is a recess at the end of the second groove portion 250 and at the beginning of a third groove portion 256. When the push button is again depressed, the ball 222 is caused to travel along the third groove portion 256 until the ball snaps into a fourth groove portion 262. When the push button 58 is released, the ball travels along the fourth groove portion 262, which is of a dog leg shape, until the ball snaps into the beginning recess 244.

In both FIGS. 6 and 7, the latch disabling member 148 is shown in full lines in its enabling position, in which the latching mechanism 220 is fully operative, as just described. The slot 228 allows the ball 222 to travel freely around all four grooved portions of the track 224.

In FIG. 7, the disabling position of the latch disabling member 148 is shown in broken lines, displaced to the right from the enabling position. The member 148 is moved to its disabling position by the movement of thc blower switch carriage 80 to the right to its OFF position, which is the most remote position from the air conditioner switch component 54. As previously described, the carriage 80 engages the tab 150 and pushes the slidable interlock link 147 to the right, against the biasing action of the coil spring 152, as shown in FIG. 22. The link 147 causes the disabling member 148 to move to the right to its disabling position, as shown in FIG. 22. This is the broken line position of the member 148, as shown in FIG. 7. When the member 148 is moved to this position, the end of the slot 228 pushes the ball 222 out of the latching seat 252 and back into the first groove portion 246, so that the push button 58 and the carriage 160 are unlatched. The return spring 162 causes the push button 58 to move outwardly to its fully extended OFF position.

If the push button 58 is depressed when the latch disabling member 148 is in its disabling position, as shown in broken lines in FIG. 7, the push button will not be latched, because the slot 228 in the member 148 forces the ball 222 to travel along the first groove portion 246 and prevents the ball 222 from moving into the latching seat 252. Since the ball 222 can only travel along the first groove portion 246, no latching is possible.

Accordingly, the air conditioner push button 58 can not be latched in its depressed or ON position when the blower switch component 52 is in its OFF position. This interlocking action prevents the air conditioner from running continuously when the blower is not energized. Accordingly, any build-up of frost on the cooling coil is prevented. This interlocking action is accomplished by the interlock mechanism 62, which includes the slidable link 147, the latch disabling member 148 and the biasing spring 152. When the blower switch carriage 80 is in any position other than its OFF position, the spring 152 biases the link 147 and the member 148 to the left, to their enabling positions. When the carriage 80 is moved to the right to its OFF position, most remote from the air conditioner switch component 54, as shown in FIG. 22, the carriage 80 engages the tab 150 and pushes the slidable link 147 to the right against the biasing action of the spring 152, whereupon the link 147 moves the member 148 to its latch disabling position.

We claim:

1. A combination blower and air conditioner switch device for vehicles, comprising a blower switch having first casing means, an air conditioner switch having second casing means secured alongside said first casing means, a blower control member movable in said first casing means along a path between an OFF position remote from said second casing means and at least one ON position along said path closer to said second casing means, blower contact means operable by said blower control member to an open position when said blower control member is in said OFF position while being operable to a closed position with said blower control member in said ON position, means for moving said blower control member along said path, an air conditioner control member movable in said second casing means between circuit opening and closing positions, a return spring for biasing said air conditioner control member toward said circuit opening position, air conditioner contact means operable by said air conditioner control member to an open position with said air conditioner control member in said circuit opening position while being operable to a closed position with said air conditioner control member in said circuit closing position, latching means for latching said air conditioner control member in said circuit closing position, said latching means including a latching element, and interlock means movable between enabling and disabling positions and including a disabling member for engaging said latching element to disable said latching means with said interlock means in said disabling position, said interlock means including operating means connected to said disabling member for moving said disabling member to said disabling position when said blower control member is moved away from the direction of said second casing means to said OFF position while moving said disabling member to said enabling position when said blower control member is moved from said OFF position toward said second casing means, said latching means thereby being disabled from latching said air conditioner control member in said circuit closing position when said blower control member is in its OFF position, said latching means being enabled to latch said air conditioner control member in said circuit closing position when said blower control member is moved away from said OFF position to said ON position.

2. A switch device according to claim 1, said operating means including a link connected to said disabling member and movable generally parallel with said path of said blower control member, said link having a tab portion projecting into the path of said blower control member as it is moved to said OFF position.

3. A switch device according to claim 2, said operating means including spring means biasing said disabling member toward its enabling position.

4. A switch device according to claim 1, said operating means including a link connected to said disabling member and movable generally parallel with said path of said blower control member, said link having a tab portion projecting into the path of said blower control member as it is moved to said OFF position, means on said first casing means for slidably guiding said link, and a spring biasing said link and said disabling member toward the enabling position of said member.

5. A switch device according to claim 4, including disengageable connecting means between said link and said disabling member.

6. A switch device according to claim 5, said disengageable connecting means comprising a slotted member with a slot therein and a tab member having a tab received in said slot.

* * * * *